United States Patent [19]

Fleischer

[11] Patent Number: 5,011,554

[45] Date of Patent: Apr. 30, 1991

[54] RUTHENIUM ALUMINUM INTERMETALLIC COMPOUNDS

[75] Inventor: Robert L. Fleischer, Schenectady, N.Y.

[73] Assignee: General Electric Company, Schenectady, N.Y.

[21] Appl. No.: 457,009

[22] Filed: Dec. 26, 1989

[51] Int. Cl.[5] ..... C22C 21/00

[52] U.S. Cl. ..... 148/430; 148/437; 420/462; 420/528

[58] Field of Search ..... 420/528, 462; 148/437, 148/430

[56] References Cited

PUBLICATIONS

"Development Potential of Advanced Intermetallic Materials", Interim Technical Report No. 12, Contract No. F33615-86-C-5055, R. L. Fleischer.

"Development Potential of Advanced Intermetallic Compounds", Interim Technical Report No. 9, Contract No. F33615-86-C-5055, R. L. Fleischer.

*Primary Examiner*—R. Dean

*Attorney, Agent, or Firm*—James E. McGinness; James C. Davis, Jr.; James Magee, Jr.

[57] ABSTRACT

Intermetallic compounds of ruthenium and aluminum are disclosed comprising about 40 to 51 atomic percent aluminum and the balance substantially ruthenium. The intermetallic compounds have a high hardness up to about 1150° C. and have good room temperature toughness. Hardness is improved by scandium additions up to about 7 atomic percent. Hardness is improved while maintaining good room temperature toughness by boron additions up to about 1 atomic percent.

18 Claims, No Drawings

RUTHENIUM ALUMINUM INTERMETALLIC COMPOUNDS

The United States government has rights in this invention pursuant to Contract No. F33615-86-C-5055 awarded by the U.S. Air Force.

This invention is related to copending application Ser. No. 07/477,793 filed Feb. 9, 1990.

BACKGROUND OF THE INVENTION

This invention relates to high temperature alloys, and more particularly to intermetallic compounds comprising ruthenium and aluminum, herein referred to as ruthenium aluminides, having high hardness at elevated temperatures and good room temperature toughness.

Intermetallic compounds are alloys having a simple stoichiometric proportion between the components and having a crystal structure different from the crystal structure of the component elements. The structure of intermetallic compounds is homogeneous over a typically narrow composition range where atoms of each component occupy ordered sites in the crystal lattice. Many intermetallic compounds have been studied because of their potential for use at elevated temperatures. The compounds can have greater stiffness than the metals from which they are formed, and have higher strength at elevated temperatures as compared to disordered alloys. In many cases low specific gravities give intermetallic compounds a high ratio of stiffness-to-density and strength-to-density, two quantities that are highly desirable in aircraft or rotating parts.

A serious problem in the use of intermetallic compounds comes from their tendency toward brittleness. Brittleness in intermetallic compounds is shown by poor ductility or poor toughness at low temperatures such as room temperature. Toughness is the ability of a material to absorb impact energy. A result of such brittleness is that many intermetallic compounds cannot be formed extensively and the articles that can be formed are susceptible to damage in their normal use and handling.

A well known intermetallic compound system is the titanium aluminides. Many of the advances from the research of titanium aluminides produced alloys having a reduced tendency toward brittleness while maintaing a high strength at elevated temperatures. For example in U.S. Pat. No. 4,292,077 to Blackburn et al., trititanium aluminides consisting of about 24–27 atomic percent aluminum, 11–16 atomic percent niobium, and the balance titanium are disclosed as having good high temperature strength with low temperature ductility. The Blackburn alloys are disclosed as being useful at temperatures of about 600° C.

It is well known within the metallurgical art that indentation hardness is an indicator of the yield strength of materials, "The Indentation of Materials by Wedges," Hirst, W., Howse, M. G. J. W., Proceedings of the Royal Society A., Vol. 311, pp. 429–444 (1969). Therefore a comparative determination of the high temperature strength of different materials can be made from comparing the high temperature indentation hardness of the materials.

An additional concern for high temperature materials is the resistance of the material to oxidation. For example, titanium aluminide intermetallic compounds are considered to have good oxidation resistance up to about 600° C. because of the formation of stable aluminum oxide scales on the surface of such alloys.

An object of this invention is to provide intermetallic compounds having a high hardness and high strength at temperatures up to about 1150° C., and good toughness at room temperature.

Another object is to provide intermetallic compounds having good oxidation resistance up to about 1000° C.

BRIEF DESCRIPTION OF THE INVENTION

I have discovered intermetallic compounds of ruthenium and aluminum having a high hardness up to about 1150° C. and good room temperature toughness comprising, 40 to 51 atomic percent aluminum and the balance substantially ruthenium. Such ruthenium-aluminum intermetallic compounds are herein referred to as ruthenium aluminides. A more preferred range comprises 45.5 to 50 atomic percent aluminum, and the balance ruthenium. Ruthenium aluminides disclosed herein have good oxidation protection up to about 1000° C., however, a preferred range for oxidation resistance comprises 46 to 48 atomic percent aluminum and the balance substantially ruthenium. Intermetallic compounds are sometimes abbreviated herein as for example Ru-40Al being 40 atomic percent aluminum and the balance ruthenium.

I have also discovered that the high temperature hardness of ruthenium aluminides can be increased by addition of scandium up to 7 atomic percent, preferably up to 5 atomic percent. High temperature hardness and low temperature ductility and toughness are improved in ruthenium aluminides by addition of boron up to 1 atomic percent, preferably up to 0.5 atomic percent.

As used herein, the term "balance substantially ruthenium," means that the ruthenium is the predominant element being greater in weight percent than any other element present in the alloy. However, other elements which do not interfere with achievement of the high hardness at temperatures up to 1150° C. and good room temperature impact strength of the intermetallic compounds may be present either as impurities or up to non-interfering levels.

The term "high hardness up to 1150° C.," means the Vickers hardness at a given temperature up to 1150° C. is comparable to the hardness of Ti-24Al-11Nb.

The term "good room temperature toughness," means the room temperature toughness is comparable to the toughness of Ti-24Al-11Nb.

The term "good oxidation resistance," means the oxidation resistance is superior to the oxidation resistance of Ti-24Al-11Nb up to about 1000° C.

DETAILED DESCRIPTION OF THE INVENTION

Ruthenium aluminides disclosed herein can be prepared by the processes used for other alloys having high melting temperatures. For example ruthenium aluminides can be melted by arc-melting or induction melting in a copper crucible under a protective atmosphere. Ruthenium aluminides can also be prepared by powder metallurgy techniques, such as admixing finely comminuted alloying ingredients followed by consolidation through the application of heat and pressure.

Shaped structural articles can be produced by casting the ruthenium aluminide from the molten state. Optionally the casting is hot-isostatically pressed to reduce porosity. Molten ruthenium aluminides can also be rapidly solidified into folis, and the foils consolidated through the application of heat and pressure. Admixed powders of the ruthenium aluminide ingredients can be shaped into articles by pressing and consolidating the pressed article through the application of heat and pressure.

Ruthenium aluminides disclosed herein have a microstructure predominately of the cesium chloride structure herein referred to as the ordered body centered cubic structure. The ordered body centered cubic structure can be described by reference to a simple cube having atoms located at each corner of the cube and one atom at the center. The corner atoms are one element, for example aluminum, and the atom at the center of the cube is a second element, for example ruthenium. The volume fraction of the ordered body centered cubic structure is at least about 80 percent in the ruthenium aluminides of this invention.

The following Example shows some of the desirable properties of the ruthenium aluminides disclosed herein.

EXAMPLE

Ruthenium aluminide samples were prepared by melting high purity ruthenium and aluminum according to the compositions shown below in Table I. In some samples scandium or boron was added to the intermetallic compound as shown in Table I. Samples were prepared by arc-melting, casting in chilled copper molds, and heat treating at 1350° C. for 20 hours in argon filled silicon dioxide ampules that included a small piece of yttrium to getter oxygen. The castings were cut and polished into 1.0×0.5×0.5 cm bar samples, and subjected to hardness and compression testing.

Vickers hardness of the samples was measured at room temperature and at elevated temperatures on a Nikon-GM tester, using a diamond pyramid indenter and a load of 1,000 grams in conformance with ASTM E 92, "Standard Test Method for Vickers Hardness of Metallic Materials," Annual Book of ASTM Standards, Vol. 3.01, 1989. The testing was performed in a vacuum of about $10^{-8}$ atmospheres, or slightly less at the highest temperatures where some outgassing or vaporization of the sample may occur.

A measurement of room temperature ductility was made on some samples by determining the percentage of plastic strain at the maximum load in compression. Compression testing was performed in conformance with ASTM E 9 "Standard Test Methods of Compression Testing of Metallic Materials at Room Temperature," Annual Book of ASTM Standards, Vol. 3.01, 1989.

A simple measure of room temperature toughness was performed on the as-cast and annealed samples by a chisel impact test. A steel chisel and a hammer of either 160 grams or 729 grams was used in the impact test. The steel chisel was placed against the sample and struck sharply with one of the hammers. Ratings were developed for the test as follows; 0 is a sample that broke upon cooling after casting or after a light tap of the 160-gram hammer, a 1 rating required repeated sharp blows with the 160-gram hammer to fracture the sample, a 2 rating required repeated sharp blows with the 729-gram hammer to fracture the sample, and samples were given a 3 rating when repeated sharp blows with the 729-gram hammer did not cause fracture of the sample. This test is not a standardized test but gives a relative rating of toughness when samples are tested in the same manner.

The volume fraction of ordered body centered cubic structure was determined by metallographic inspection of polished samples. The results of the above described tests performed on the ruthenium aluminides prepared in this Example are shown below in Table I.

TABLE I

MECHANICAL PROPERTIES OF RUTHENIUM ALUMINUM INTERMETALLIC COMPOUNDS

| Test No. | Composition Atomic %; Ru | Al | Sc | B | Average Vickers Hardness (kg/mm²) Room Temp. | 950° C. | 1150° C. | Room Temp. Chisel Impact Rating | Compression Percent Strain to Max. Load | Volume Fraction Ordered Body Centered Cubic (%) |
|---|---|---|---|---|---|---|---|---|---|---|
| 1 | 47 | 53 | | | 373 | 198 | 135 | 1 | 0 | 99 |
| 2 | 50 | 50 | | | 311 | 186 | 117 | 3 | 9 | 100 |
| 3 | 51.5 | 48.5 | | | 312 | 142 | 89 | 3 | | 98 |
| 4 | 53 | 47 | | | 286 | 166 | 116 | 3 | >16 | 93 |
| 5 | 54.5 | 45.5 | | | | 151 | 94 | 3* | | 95 |
| 6 | 52 | 46 | 2 | | 267 | 190 | 145 | 2 | | 92 |
| 7 | 52 | 43 | 5 | | 352 | 263 | 205 | 2 | | 91 |
| 8 | 50 | 40 | 10 | | 357 | 397 | 281 | 1 | | 91 |
| 9 | 50 | 25 | 25 | | 295 | 251 | 222 | 0 | | 87 |
| 10 | 47 | 53 | | 0.5 | 552 | 413 | 99 | 1 | 6 | 99 |
| 11 | 50 | 50 | | 0.5 | 280 | 207 | 120 | 3 | 22 | 99 |
| 12 | 53 | 47 | | 0.5 | 327 | 240 | 140 | 3* | 34 | 94 |

*Same impact rating when tested at −196° C.

Note tests 11, 12, and 13 contain 0.25 atomic percent less ruthenium and 0.25 atomic percent less aluminum as a result of the boron addition.

Table II below contains the Vickers hardness and chisel impact rating from samples of a tritanium aluminide within the composition of the '077 patent discussed above. The tritanium aluminide samples were prepared according to processes well known in the industry to provide optimum properties for Ti-24Al-11Nb alloys.

TABLE II

MECHANICAL PROPERTIES FOR TRITITANIUM ALUMINIDE INTERMETALLIC COMPOUND OF ABOUT Ti-24Al-11Nb

| Average Vickers Hardness (kg/mm²) Room Temp. | 815° C. | Room Temperature Chisel Impact Rating |
|---|---|---|
| 316 | 173 | 2 |

First the properties of the ruthenium aluminides shown in Table I are compared. Ruthenium aluminides containing 53 atomic percent aluminum have a high hardness at room and elevated temperatures but the toughness is poor. For example see test nos. 1 and 10 both having 53 atomic percent aluminum and chisel impact ratings of 1. However when aluminum is less than 53 atomic percent a high hardness is maintained at room and elevated temperatures up to 1150° C. with excellent toughness. For example see test nos. 2,3,4, and 5 having from 50 to 45.5 atomic percent aluminum and chisel impact ratings of 3.

Scandium additions of 10 atomic percent or greater in ruthenium aluminides are beneficial to hardness but adversely affect toughness. Lower scandium additions provide good impact strength and are beneficial to hardness. For example test nos. 6 and 7 containing 2 and 5 atomic percent scandium respectively, have a higher Vickers hardness at room temperature and at 1150° C. than test nos. 2 to 5 that do not contain scandium additions. The effect of scandium on toughness is shown by test nos. 8 and 9 that contain 10 and 25 atomic percent scandium respectively and have chisel impact ratings of 1 and 0 as compared to test nos. 6 and 7 having 2 and 5 atomic percent scandium respectively and chisel impact ratings of 2.

Boron additions of 0.5 atomic percent to ruthenium aluminides containing less than 53 atomic percent aluminum provide high hardness at room and elevated tmperatures up to 1150° C. with excellent toughness. For example, of the ruthenium aluminide samples containing 0.5 atomic percent boron, compare test no. 10 containing 53 atomic percent aluminum and having a chisel impact rating of 1 to test nos. 11 and 12 containing 50 and 47 atomic percent aluminum respectively, both having chisel impact ratings of 3.

The room temperature ductility of the ruthenium aluminide samples as shown by the percent of plastic strain to maximum load in compression, is in agreement with the chisel impact ratings. Ruthenium aluminide samples having the higher impact ratings also have a higher percent strain to maximum load. As a result ruthenium aluminides containing 53 atomic percent aluminum have a low ductility while ruthenium aluminides containing less than 53 atomic percent aluminum have a higher ductility. Compare test 1 having 53 atomic percent aluminum and 0 percent plastic strain to maximum load, to tests 2 and 4 having 50 and 47 atomic percent aluminum respectively with 9 and greater than 16 percent strain to maximum load.

Boron additions of 0.5 atomic percent also improved room temperature ductility. Tests 11 and 12 have similar compositions to tests 2 and 4 but tests 11 and 12 additionally contain 0.5 atomic percent boron and have a higher percent strain to maximum load by 13 and 18 percent respectively.

A chisel impact test at liquid nitrogen temperatures, about −196° C., on samples from tests 5 and 12 resulted in the same 3 rating that was achieved at room temperature. Retention of room temperature toughness at liquid nitrogen temperatures is another indication of the good toughness of the ruthenium aluminides disclosed herein.

As discussed above, the trititanium aluminide Ti-24Al-11Nb is a material having high strength at elevated temperatures up to about 600° C. with good low temperature ductility. Since yield strength has been shown to be related to indentation hardness it follows that Ti-24Al-11Nb is a material having good high temperature hardness. The Vickers hardness and chisel impact ratings of the ruthenium aluminide samples in Table I are next compared to the titanium aluminide samples in Table II.

As compared to Ti-24Al-11Nb, the ruthenium aluminides of this invention have a comparable or higher hardness at low temperatures and elevated temperatures. In fact several ruthenium aluminides have a higher hardness at 950° C. than the hardness at 815° C. of Ti-24Al-11Nb. Similarly, the room temperature toughness is comparable or superior in the ruthenium aluminides of this invention as compared to Ti-24Al-11Nb. Again, since indentation hardness is related to yield strength and the hardness of the ruthenium aluminides disclosed herein is comparable or superior to Ti-24Al-11Nb it follows that the ruthenium aluminides of this invention have good high temperature strength up to about 1150° C.

The oxidation resistance of the ruthenium aluminides disclosed herein was determined by measuring oxide growth rates. Samples from heat treated castings having the composition of test 2, Ru-50Al, and 4, Ru-47Al, in Table I were roughly polished with silicon carbide polishing paper and heated in flowing air at 1000° C. The weight gain on the samples from the growth of an oxide was measured as a function of time. For comparison, the oxide growth on a sample of the Ti-24Al-11Nb alloy was also measured at 900° C. The measured weight gains are shown below in Table III.

TABLE III

WEIGHT GAIN FROM OXIDE GROWTH ON Ru-Al, Ru-47Al, AND Ti-24Al-11Nb.

| TIME (HOURS) | 900° C. Ti-24Al-11Nb WEIGHT GAIN ($mg/cm^2$) | 1000° C. Ru-Al WEIGHT GAIN ($mg/cm^2$) | 1000° C. Ru-47Al WEIGHT GAIN ($mg/cm^2$) |
|---|---|---|---|
| 0.5 | 0.077 | 0.335 | 0.207 |
| 1 | 0.165 | 0.473 | 0.284 |
| 2 | 0.435 | 0.644 | 0.361 |
| 3 | 0.466 | — | 0.428 |
| 3.5 | — | 0.553 | — |
| 4 | 0.622 | — | 0.456 |
| 4.5 | — | 0.619 | — |
| 5 | 0.802 | — | 0.474 |
| 5.5 | — | 0.871 | — |
| 6 | 0.947 | — | 0.474 |

The rate of oxide growth measured on the samples shown in Table III follows a generally parabolic rate of oxide growth. As a layer of oxide grows on a substrate it impedes the diffusion of oxygen to the substrate and therefore slows the rate of oxidation in a parabolic manner. From the data in Table III the well known parabolic rate constant, a measure of the parabolic rate of oxide growth, can be calculated for each sample. A smaller value for the parabolic rate constant means a slower rate of oxide growth. The parabolic rate constant for each sample was; $2.8\times10^{-9}$ $grams^2/cm^4 \cdot sec.$ for Ti-24Al-11Nb, $3.2\times10^{-11}$ $grams^2/cm^4 \cdot sec.$ for Ru-Al, and $1.2\times10^{-11}$ $grams^2/cm^4 \cdot sec.$ for Ru-47Al.

The ruthenium aluminides have a much slower rate of oxide growth at 1000° C. than the trititanium aluminide Ti-24-Al-11Nb has at 900° C. Between the ruthenium aluminide compositions tested the lower aluminum Ru-47Al has the lower rate of oxide growth. As a result ruthenium aluminides are considered good oxidation resistant materials up to about 1000° C., with Ru-47Al in particular having good oxidation resistance.

Contemplated uses for the ruthenium aluminides disclosed herein include elevated temperature applications such as jet engine components. For example contemplated uses include; compresser wheels or blades, turbine wheels or blades, or more generally for applications requiring lightness in weight and retention of strength at elevated temperatures such as plates, channels, or equivalent structural components, tubes, engine housings, or shrouds.

I claim:

1. An intermetallic compound of ruthenium and aluminum comprising: about 40 to 51 atomic percent aluminum and the balance substantially ruthenium, the intermetallic compound having a high hardness up to about 1150° C., and good room temperature toughness.

2. The alloy of claim 1 further comprising up to 7 atomic percent scandium.

3. The alloy of claim 1 further comprising up to 1 atomic percent boron.

4. The alloy of claim 1 further comprising up to 5 atomic percent scandium.

5. The alloy of claim 1 further comprising up to 0.5 atomic percent boron.

6. An intermetallic compound of ruthenium and aluminum comprising: about 45.5 to 50 atomic percent aluminum and the balance substantially ruthenium, the intermetallic compound having a high hardness up to about 1150° C., and good room temperature toughness.

7. The intermetallic compound of claim 6 comprising about 46 to 48 atomic percent aluminum and having good oxidation resistance up to about 1000° C.

8. The alloy of claim 6 further comprising up to 7 atomic percent scandium.

9. The alloy of claim 6 further comprising up to 1 atomic percent boron.

10. The alloy of claim 6 further comprising up to 5 atomic percent scandium.

11. The alloy of claim 6 further comprising up to 0.5 atomic percent boron.

12. A structural member having a high hardness at elevated temperatures up to about 1150° C. and good room temperature toughness comprising an intermetallic compound of about 40 to 51 atomic percent aluminum and the balance substantially ruthenium.

13. The structural member of claim 12 comprising about 45.5 to 50 atomic percent aluminum.

14. The structural member of claim 12 comprising about 46 to 48 atomic percent aluminum and having good oxidation resistance up to about 1000° C.

15. The alloy of claim 12 further comprising up to 7 atomic percent scandium.

16. The alloy of claim 12 further comprising up to 1 atomic percent boron.

17. The alloy of claim 12 further comprising up to 5 atomic percent scandium.

18. The alloy of claim 12 further comprising up to 0.5 atomic percent boron.

* * * * *